US006412555B1

(12) United States Patent
Sten-Halvorsen et al.

(10) Patent No.: US 6,412,555 B1
(45) Date of Patent: Jul. 2, 2002

(54) SYSTEM AND METHOD FOR CONTROLLING FLUID FLOW IN ONE OR MORE OIL AND/OR GAS WELLS

(75) Inventors: Vidar Sten-Halvorsen; Einar Stølen, both of Kongsberg (NO)

(73) Assignee: Kongsberg Offshore A.S., Kongsberg (NO)

( * ) Notice: Subject to any disclaimer, the term of this patent is extended or adjusted under 35 U.S.C. 154(b) by 0 days.

(21) Appl. No.: 09/701,294

(22) PCT Filed: Jun. 4, 1999

(86) PCT No.: PCT/NO99/00185

§ 371 (c)(1),
(2), (4) Date: Nov. 28, 2000

(87) PCT Pub. No.: WO00/00716

PCT Pub. Date: Jan. 6, 2000

(30) Foreign Application Priority Data

Jun. 18, 1998 (NO) ..... 2823/98

(51) Int. Cl.[7] ..... E21B 47/00

(52) U.S. Cl. ..... 166/250.03; 166/250.15; 166/265; 166/373; 166/386; 166/54.1; 73/61.44; 73/152.55

(58) Field of Search ..... 166/250.03, 386, 166/250.01, 250.15, 264, 265, 369, 373, 54.1; 73/61.44, 152.55

(56) References Cited

U.S. PATENT DOCUMENTS

| | | | | |
|---|---|---|---|---|
| 4,187,912 | A | | 2/1980 | Cramer |
| 4,345,647 | A | | 8/1982 | Carmichael |
| 4,360,778 | A | | 11/1982 | Freedman |
| 4,361,808 | A | | 11/1982 | Kern et al. |
| 4,727,936 | A | * | 3/1988 | Mioduszewski et al. |
| 4,831,331 | A | | 5/1989 | De et al. |
| 5,049,037 | A | | 9/1991 | Carson et al. |
| 5,063,775 | A | * | 11/1991 | Walker et al. |
| 5,616,856 | A | * | 4/1997 | Castel |
| 5,767,680 | A | | 6/1998 | Torres-Verdin et al. |

* cited by examiner

*Primary Examiner*—Roger Schoeppel
(74) *Attorney, Agent, or Firm*—Rothwell, Figg, Ernst & Manbeck

(57) ABSTRACT

System and method for controlling fluid flows in one or more oil and/or gas wells in a geological formation, the wells each comprising a production tube, the formation containing a water-containing volume with a higher water level, comprising: one or more measuring devices, each mounted in relation to a chosen zone of a well for measuring the distance to the water level in the zone, one or more valve devices comprised in the production tubes for regulating the fluid flow from the surrounding formation to the production tube, one or more control units connected to each of the valves for regulating then on the basis of the measured distance or distances.

15 Claims, 3 Drawing Sheets

SYSTEM AND METHOD FOR CONTROLLING FLUID FLOW IN ONE OR MORE OIL AND/OR GAS WELLS

This invention relates to a system and a method for controlling fluid flows in an oil or gas well in a geological formation, the formation including a water containing area and border surface or water level between the water containing area and a bordering volume of oil or

FIELD OF THE INVENTION

In oil or gas production it is a reoccurring problem that water enters the well at different positions. The water is transported to the surface together with the hydrocarbons and has to be separated at the surface. This gives extra expenses for the operator also represents a pollution problem, as the separated water has to be cleaned before it is let out into the environment.

When the water content is too large the well is closed and abandoned, even if some zones in the well may still contain oil resources. This becomes a weighting between the costs related to separating and cleaning of the water and the possible income from producing the oil. The typical degree of the exploitation of oil wells today is approximately 35%, and an improvement of only a few percent will therefore give large amounts of money for the oil companies. Thus it is a main object for this invention to obtain an improved emptying/exploitation of the reservoirs.

BACKGROUND OF THE INVENTION

A number of techniques for rinsing the water at the surface are known. For example, in the U.S. Pat. Nos. 4,187,912 and 4,345,647 the use of separation tanks positioned in the well, in which the oil containing fluid is lead into the tank, and is taken out from the top of the tank. This method will be able separate some water and particles from the oil, but represents a complicated and awkward solution.

U.S. Pat. No. 5,049,037 describes a solution in which a movable pump is used to pump the oil up. The pump is kept above the oil/water surface. This also represents a complicated and awkward technique. Also, it will not be suitable for horizontal wells, in which the oil/water surface may be different along the different parts of the well, and in which the water enters the well at different positions, between the oil producing parts of the well.

As mentioned oil and gas wells penetrate several oil bearing and non-oil bearing geological formations, and it is unnecessary and expensive to close the well because significant amounts of water has entered the well in one or more parts. At the same time it is, as mentioned, expensive to separate and thereafter separate the water from the oil after it has been brought to the surface. In larger systems the production tubes from a number of wells are brought together in a manifold in which it is advantageous to detect which wells are producing, or are about to produce, water, so that they may be closed or adjusted individually.

SUMMARY OF THE INVENTION

It is an object of this invention to provide a method and a system for reducing the water production while improving the exploitation of a well at the same time as the oil production is maintained. This object is obtained with a system and a method as given above and being characterized according to the independent claims.

This way a possibility is provided for optimizing the oil or gas production in wells passing through several geological formations with varying oil/gas-levels.

BRIEF DESCRIPTION OF THE DRAWINGS

The invention is described below with reference to the accompanying drawing, which by way of example illustrate the invention.

DESCRIPTION OF THE PREFERRED EMBODIMENTS

Figure 1:
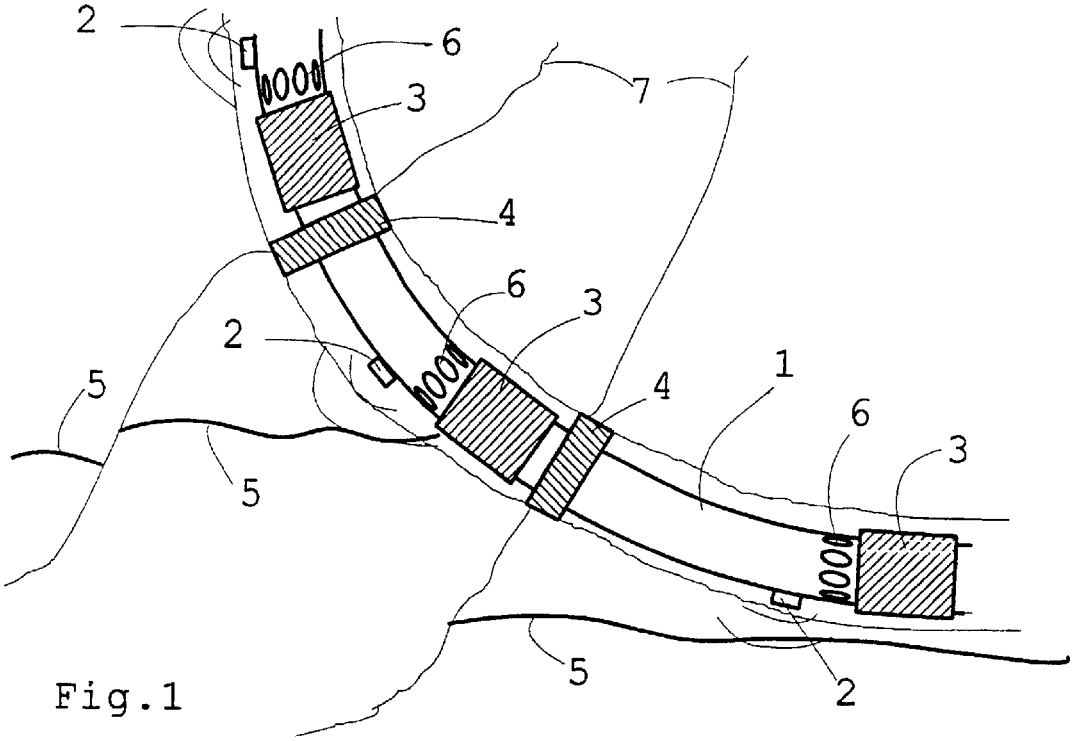
FIG. 1 shows a production tube positioned in a well provided with a system according to the invention.

In FIG. 1 a production tube 1 is shown penetrating three different formations separated by two border layers 7 hindering or limiting the fluid flow between the formations, which therefore has different oil/water levels 5 between oil, or possibly gas, and water, hereby defined as the water level 5.

Functional details, such as cables for power supply or data transfer, as well as possibly a casing, is of illustration purposes omitted in FIG. 1.

In each formation zone a measuring instrument 2 is provided being adapted to measure the distance to the water level 5. This instrument may be of a number of different types, but in a preferred embodiment of the invention an electromagnetic transmitter and receiver is used. As the water in the formation usually is contaminated with salt etc. it will, in contrast to the case with the surrounding formation containing oil and/or gas, be electrically conductive. Thus an emitted electromagnetic pulse will be reflected by the water level 5. By e.g. measuring the time lapse for the reflected pulse the distance to the water level may be measured.

Preferably, however, the measuring technique is based on continuous emission of a coherent electromagnetic wave, and analysis or the variation in the resulting standing wave between the water level and the transmitter when the water level moves. Use of a plurality of frequencies may provide the distance to the water level.

The measuring device 2 is preferably position directly in contact with the geological formation. If the well comprises a casing 8 (see FIG. 2) the measuring instrument is positioned in a hole in the casing 8, or possibly outside it, so that it does not influence or suppress the signals.

Preferably the measuring instrument is adapted to measure the direction of the reflected signal, so that the direction of the water levels 5 movement may be measured. If the measuring instrument is based on the emission of electromagnetic waves in the radio frequency range this may be obtained simply by using direction sensitive antennas.

As mention above other per se known techniques for measuring the distance to the water level may be used, e.g. acoustic measurements, use of neutron radiation, magnetic measuring techniques or simply direct contact with the water, without being essential to the present invention.

When the water level 5 comes within a certain distance from the tube one or more valves 3, 6 are provided related to each geological zone. In the figure the valves 3, 6 consists of a shiftable cylindrical sleeve which completely or partially may cover a number of openings in the production tube 1. The control mechanisms for the sleeve is of illustration purposes not shown, but may essentially be made from known parts for controlling sliding sleeves.

Different other types of valves may also be used, preferably of a type being controllable from the surface or from equipment positioned in the well.

Placed by the transition layers 7 between the formations the figure shows packing 4 hindering the fluids from flowing along the well outside the production tube 1. The packers may be standard packers for use in oil or gas wells.

When the water level 5 in a zone gets closer to the valve in the zone the valve may be closed so as to avoid water entering the production tube 1. Thus the production in the other areas in the well may be continued unaffected. In one especially preferred embodiment of the invention the distance to the water level is measured repeatedly and the velocity is calculated to predict when the water will enter the related valve. By partially closing the valve the velocity may be reduced, and by individually controlling each of the valves the production in the different areas of the well may be regulated so that the water level 5 reaches the separate valves 3, 6 at the same time. Thus an optimal production of the well is provided without entering of water.

Figure 2:
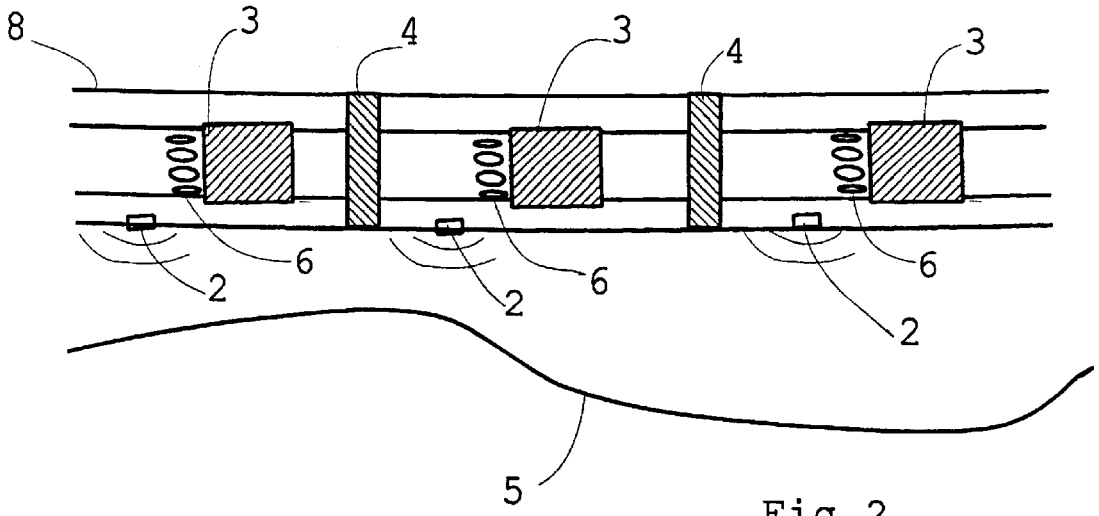
FIG. 2 illustrates a presumed progress of the oil level in the direction of a well.

In FIG. 1 the production tube is shown in an area having a curved transition from a vertical to a horizontal progress. The invention is, however, especially suitable in long, horizontal wells in which the water level may be different in different formations. Typically the geological formations will be larger than what is illustrated in the drawing. In such instances a plurality of valves/measuring instrument arrangements in each formation may be preferable, as is shown in FIG. 2. In FIG. 2 the water level 5 varies along the horizontal well, which because of anisotropies such as varying density in the oil bearing medium, or directional flow, e.g. because of directional cracks in the medium.

In FIG. 2 the well is limited in several zones in the same geological formation using packers 4, so that the production from the geological formation may be optimized in the same way as described above. This solution may be especially favourable if the well follows a chosen oil bearing formation. This type of formations may deviate from a horizontal progress and will also typically have anisotropic flow characteristics for fluid.

The optimal in the situation shown in FIG. 2 is thus that the valves are adjusted so that the water level is parallel with the well, the distance to the water level thus being at its maximum along the whole well.

Figure 3:
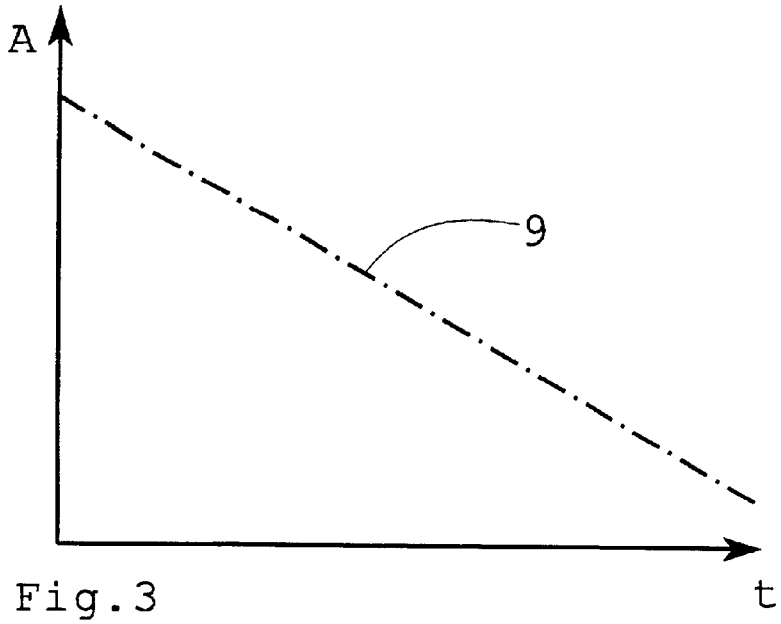
FIG. 3 illustrates a more realistic progress.
Figure 4:
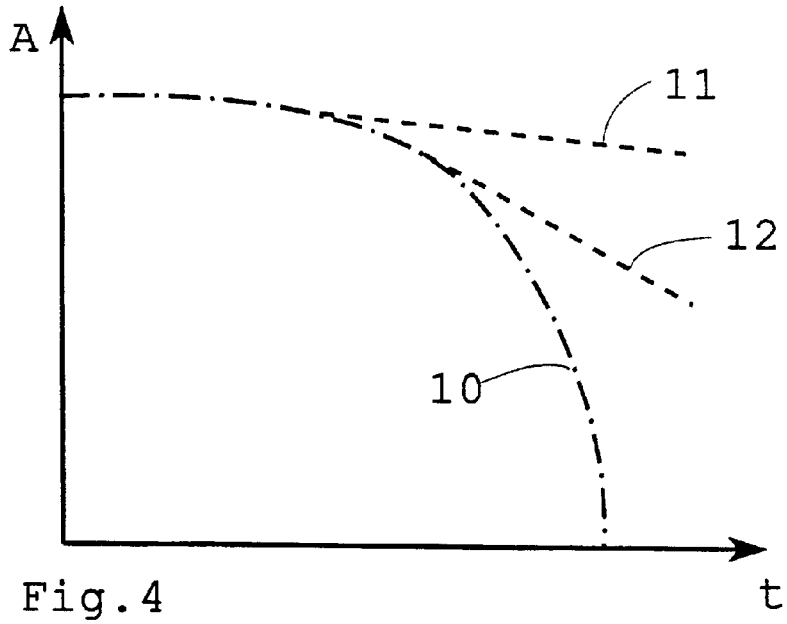
FIG. 4 shows a detail of a horizontal production tube.

Calculations of the movements of the water level is based on thee assumption that the movement is linear, as indicated with the line 9 in FIG. 3, in which A is the distance from the well to the oil/water border surface 5, and t is the time. This assumption is, however, seldom correct, but will depend on a number of conditions in the surrounding formation. In FIG. 4 a situation is shown in which the distance decreases rapidly, which means an increasing velocity toward the well, as shown in the curve 10. On this basis the present zone of the well will produce water at an earlier time than supposed by the linear calculations, as indicated by the curves 11 and 12 in FIG. 4. This progress may be significantly more complex, with a possibility for an increase in the distance to the water level, and thus it is preferable to perform repeated or continuous measurements of the distance, and more advanced calculation methods for predicting the time the water level reaches the well based on these measurements, e.g. using interpolation based on the measured distances, correlation analysis of the movements at the different measuring instruments or other calculation methods.

The prediction of the closing time at the individual valves may preferably be done on the basis of measured data from all the measured locations along the production pipe. By combining these a picture is provided of the water levels movements and the flow conditions in the surrounding geological formation.

In addition to the calculations of distances and movements of the water level the retrieved information may be used for other types of calculations. For example the movements of the water level may provide indications of the size of the oil resource in the related part of the formation, as well as permeability and other characteristics of the formation based on other known parameters of the well.

Figure 5:
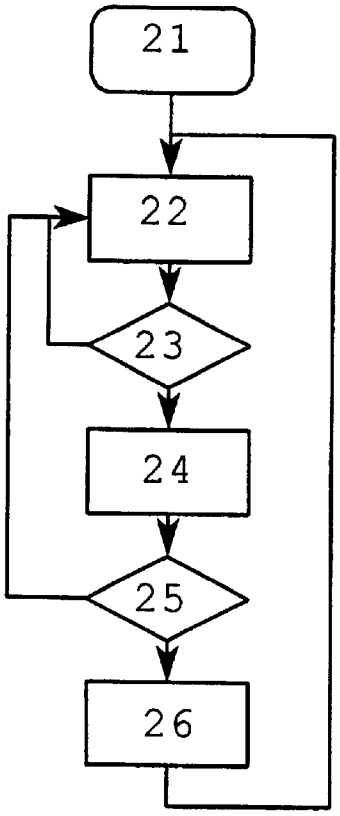
FIG. 5 illustrates the control routine for the valves.

FIG. 5 shows schematically a possible decision procedure for controlling each of the valves. The procedure comprises the following steps:

21—Starting the system

22—measuring 22 the distance to the water contact.

23—The distance is compared with a chosen limit value. If the distance is not less than the limit value the measurement 22 is performed again.

24—If the distance is less than the limit value an alarm is sent to the operator.

25—The operator decides if the corresponding valve should be adjusted. If the decision is negative the procedure is repeated from step 22.

26—The valve is adjusted and the procedure is repeated from step 22. When the corresponding valve is closed the procedure may be stopped, or the monitoring of the distance may continue in case the water level retreats, e.g. because of the flow characteristics of the formation.

Typically the steps 22 and 23 are performed a number of times, so that the movements of the water level and the rate of change may be monitored.

Using complex calculation methods, in which the velocity and the rate of change in the velocity, the control procedure may be different. The role of the operator in the example above may also be performed by an automatic procedure based on the abovementioned calculations.

Figure 6:
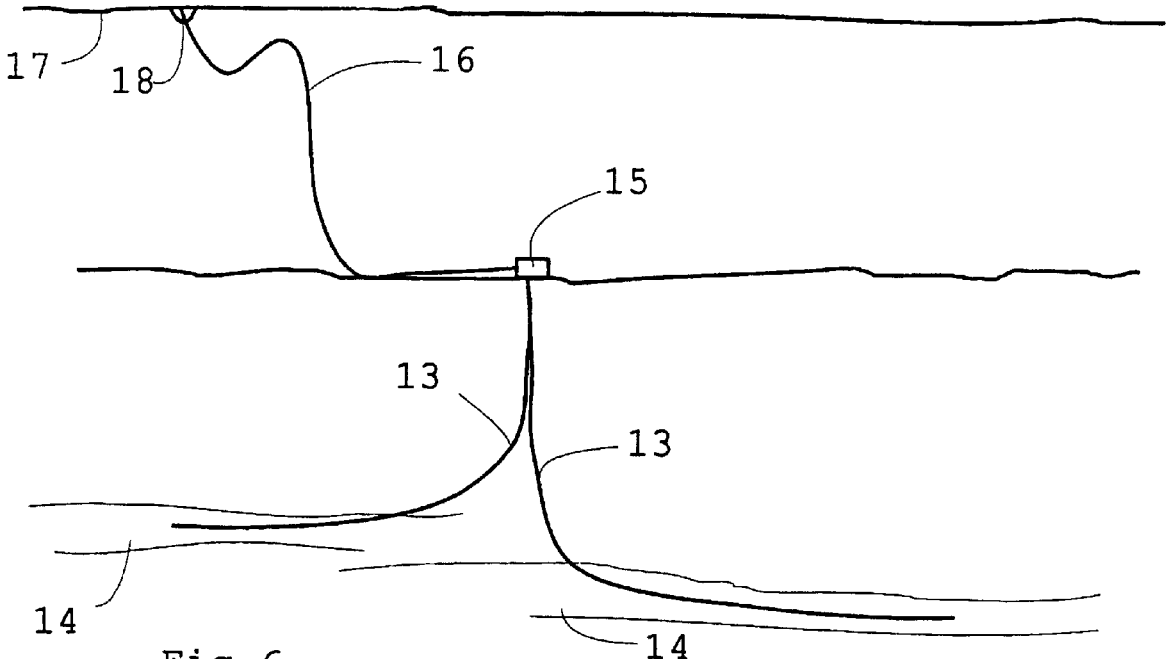
FIG. 6 illustrates a system according to the invention comprising two wells.

In FIG. 6 a more complex system comprising a number of wells 13 is shown, each following a separate oil producing layer 14. The production tubes in the different wells are connected to a manifold 15 of any suitable type, and which comprises one or more well head Christmas trees, power supplies and possible calculation units controlling the separate valves based on the retrieved information. From the manifold 15 a riser 16 of a known type leads the oil/gas up to a vessel or a platform 18 on the surface 17.

In a special embodiment of the invention the valves for controlling the fluid flow may be positioned in the manifold, and not in the production tube. This way the water production from the separate wells may be controlled, and thus hinder the water from entering the system as a whole. In such a system the measuring instruments may be positioned in the separate wells 13.

Circuits for performing the calculations and control functions may be positioned at different parts of the system without being of any significance to the idea of the invention, but will depend on the required calculating power, data transfer capacity and other characteristics of the system. Devices for power supply, power and signal transmission etc. may be of any available type, and is not essential to this invention.

Even if the invention mainly has been described relating to the purpose of avoiding water in the produced oil allowing a certain degree of water to enter may be favourable to optimize the production. The different valves may then be adjusted so as to obtain this production, depending on the local conditions in that particular situation.

The invention is here mainly described in relation to oil production, but it is evident to a person known in the art that it also may be implemented in relation to gas production.

What is claimed is:

1. A system for limiting the amount of water ingested into a petroleum extraction well used for extracting petroleum products from one or more geologic formations containing petroleum products and water substantially separated by a water interface, said system comprising:

a production tube extending into the one or more geologic formations for extracting petroleum products from the geologic formation;

one or more measuring devices disposed along said production tube, each said measuring device being constructed and arranged to determine the location of a water interface relative to a portion of said production tube, at least one measuring device being provided on said production tube for each geologic formation from which said production tube extracts petroleum products; and one or more valves disposed along said production tube, each said valve being constructed and arranged to regulate the rate of fluid flow through associated openings formed in said production tube, at least one valve and associated opening being provided on said production tube for each geologic formation from which said production tube extracts petroleum products, wherein each said valve is adjustable so as to decrease or stop the flow of fluid through said opening into said production tube when said measuring device determines that a water interface is close to said opening so as to prevent water from being ingested into said production tube through said opening.

2. The system according to claim 1, wherein one or more valves are mounted by each measuring device for locally controlling the fluid flow from the formation into the production tube.

3. The system according to claim 1, wherein the measuring device comprises an electromagnetic transmitter and receiver adapted to measure the distance between the measuring device and an electrically conducting medium.

4. The system according to claim 3, wherein said electromagnetic transmitter comprises a pulse generator, and said measuring device is adapted to measure the time lapse from the emission of a pulse to the receipt of a reflection of said pulse by said receiver.

5. The system according to claim 3, wherein said electromagnetic transmitter emits a continuous electromagnetic wave.

6. The system according to claim 1, wherein each said valve comprises axially shiftable cylindrical sliding sleeves enveloping the tube for covering/uncovering at least parts of the associated openings.

7. A system for limiting the amount of water ingested into a petroleum extraction well used for extracting petroleum products from two or more geologic formations containing petroleum products and water substantially separated by a water interface, said system comprising:

a production tube extending into the two or more geologic formations for extracting petroleum products from the geologic formation;

measuring devices disposed along said production tube, each said measuring device being constructed and arranged to determine the location of a water interface relative to a portion of said production tube, at least one measuring device being provided on said production tube for each geologic formation from which said production tube extracts petroleum products; and valves disposed along said production tube, each said valve being constructed and arranged to regulate the rate of fluid flow through associated openings formed in said production tube, at least one valve and associated opening being provided on said production tube for each geologic formation from which said production tube extracts petroleum products, wherein each said valve is adjustable so as to decrease or stop the flow of fluid through said opening into said production tube when said measuring device determines that a water interface is close to said opening so as to prevent water from being ingested into said production tube through said opening.

8. A method for limiting the amount of water ingested into a petroleum extraction well used for extracting petroleum products from one or more geologic formations containing petroleum products and water substantially separated by a water interface, said method comprising:

extending a production tube into the one or more geologic formations for extracting petroleum products from the geologic formation, said production tube having openings formed at least one position along said production tube for each geologic formation from which said production tube extracts petroleum products;

determining the location of a water interface relative to a portion of said production tube at at least one position along said production tube for each geologic formation from which said production tube extracts petroleum products; and regulating the rate of fluid flow through said openings into said production tube in response to the determined location of a water interface relative to said openings so as to decrease or stop fluid flow into said production tube when a water interface is determined to be close to said openings so as to prevent water from being ingested into said production tube through said opening.

9. The method according to claim 8, wherein the locations of the water interface are determined at one or more chosen zones in production tubes for regulating the fluid flow from the formation to the corresponding zone in the production tube.

10. The method according to claim 8, wherein the locations of the water interface are determined at chosen intervals, and variations in the locations are used to predict the closing time for the corresponding zone: in the well.

11. The method according to claim 8, wherein fluid flow is regulated by a number of cylindrical, axially shiftable sliding sleeves, and the openings are closed by moving the sliding sleeves over the openings in the production tube.

12. The method according to claim 8, wherein the locations of the water interface are determined by emission and receipt of electromagnetic waves.

13. The method according to claim 12, wherein the electromagnetic waves are emitted as pulses, and the locations of the water interface are determined as a function of the time lapse from the emission to the receipt of the reflected pulses, and the propagation velocity through the medium.

14. The method according to claim 12, wherein the electromagnetic waves are emitted as continuous waves at one or more frequencies.

15. A method for limiting the amount of water ingested into a petroleum extraction well used for extracting petroleum products from two or more geologic formations containing petroleum products and water substantially separated by a water interface, said method comprising:

extending a production tube into the two or more geologic formations for extracting petroleum products from the geologic formation, said production tube having openings formed at at least one position along said production tube for each geologic formation from which said production tube extracts petroleum products;

determining the location of a water interface relative to a portion of said production tube at at least one position along said production tube for each geologic formation from which said production tube extracts petroleum products; and regulating the rate of fluid flow through said openings into said production tube in response to the determined location of a water interface relative to said openings so as to decrease or stop fluid flow into said production tube when a water interface is determined to be close to said openings so as to prevent water from being ingested into said production tube through said opening.

* * * * *